US005764265A

United States Patent [19]

Minegishi et al.

[11] Patent Number: 5,764,265

[45] Date of Patent: Jun. 9, 1998

[54] INK JET PRINTING APPARATUS AND A PRINTING HEAD FOR SUCH AN INK JET PRINTING APPARATUS

[75] Inventors: Takahisa Minegishi, Katsuta; Hiroyuki Kawasaki, Mito; Naoshi Takahashi, Hitachi, all of Japan

[73] Assignee: Hitachi, Ltd., Tokyo, Japan

[21] Appl. No.: 626,609

[22] Filed: Apr. 2, 1996

Related U.S. Application Data

[63] Continuation of Ser. No. 301,888, Sep. 7, 1994, abandoned.

[30] Foreign Application Priority Data

Sep. 8, 1993 [JP] Japan ..... 5-223280
Sep. 8, 1993 [JP] Japan ..... 5-223283

[51] Int. Cl.[6] ..... B41J 2/01

[52] U.S. Cl. ..... 347/108; 361/681

[58] Field of Search ..... 361/681, 682; 347/108

[56] References Cited

U.S. PATENT DOCUMENTS

| | | | |
|---|---|---|---|
| D. 347,239 | 5/1994 | Okamoto et al. | D18/53 |
| 4,814,794 | 3/1989 | Sato et al. | 347/29 |
| 4,928,115 | 5/1990 | Fagerquist et al. | 347/76 |
| 5,436,652 | 7/1995 | Mizoguchi et al. | 347/108 |
| 5,444,472 | 8/1995 | Dae et al. | 347/85 |
| 5,620,269 | 4/1997 | Gustafson | 347/108 |

FOREIGN PATENT DOCUMENTS

| | | | |
|---|---|---|---|
| 54-038125 | 3/1979 | Japan | 347/108 |

*Primary Examiner*—Valerie Lund
*Attorney, Agent, or Firm*—Antonelli, Terry, Stout & Kraus, LLP

[57] ABSTRACT

An ink jet printing apparatus has a casing which is divided into upper and lower regions by a dividing wall. In the lower region, between the dividing wall and the base of the casing is an ink circulation unit. A pump of the of the ink circulation unit passes ink from a main ink container to a tube and hence to a printing head of the apparatus. The ink circulation unit may have a filter for filtering the ink before it passes to the printing head, and also have a secondary ink container and a solvent container for containing ink and solvent which are passed to the main container as they are used up during printing. Access to the containers and the filter, which need periodic replacement, is via an access cover in the casing. The access cover is at the front of the casing so that it can be used by an operator when the printing apparatus is in its normal position. Above the dividing wall is a circuit board unit which controls the ink circulation unit, and also the printing head. The circuit board unit is also close to a display panel of the printing apparatus, and is separated from a power unit by a vertical wall. Thus, since the circuit board unit and the power unit are above the ink circulation unit, spillage of ink will not affect them.

13 Claims, 8 Drawing Sheets

INK JET PRINTING APPARATUS AND A PRINTING HEAD FOR SUCH AN INK JET PRINTING APPARATUS

This application is a continuation of application Ser. No. 08/301,888 filed Sep. 7, 1994 now abandoned.

BACKGROUND OF THE INVENTION

1. Field of the Invention

The present invention relates to an ink jet printing apparatus. It relates particularly, but not exclusively, to an ink jet printing apparatus of continuous type. The present invention also relates to a printing head for such an ink jet printing apparatus.

2. Summary of the Prior Art

In a printing apparatus of continuous type, ink supplied from an apparatus body passes to a printing head. Particles of ink are jetted from the printing head in a predetermined pattern, which pattern is determined by control of the printing head. Such a printing apparatus of continuous type is used to print information, such as manufacturing date or sell-by date, onto product packaging passing the printing head.

At the printing head, ink from the body is jetted as ink particles from a nozzle past a charging electrode, which induces a charge on some of the ink particles. The pattern of charging of the particles is determined by the information that is to be printed. The particles then pass a charged deflection plate which deflects some of the particles (dependent on the charge thereon) in predetermined directions from the printing head, so that they reach the article to be printed. Other particles, however, pass to a gutter, which permits them to be returned to the main body of the printing apparatus.

Within that body, there are generally three main groups of components. The first group form an ink circulation circuit, for supplying ink to the nozzle and receiving ink returned from the gutter. Additional ink may be supplied, as may be solvent, such that the ink that reaches the nozzle is of suitable consistency.

The ink circulating unit, and possibly the printing head itself, are controlled by suitable electronic components. Those electronic components may be mounted on a circuit board to form a circuit board unit. The main body will also normally contain a power unit for supplying power to the other components, and have a display panel which permits the operator to control the printing by the printing head. An example of such a printing apparatus of continuous type is disclosed in, for example, WO-A-89/03768. Furthermore, JP-A-5-77439 describes cleaning of the nozzle of the printing head via a solvent, and JP-A-3-28243 discusses the direction of ink jetted from the printing head.

SUMMARY OF THE PRESENT INVENTION

A first aspect of the present invention is concerned with the internal arrangement of the ink jet printing apparatus. As was mentioned above, the apparatus has an ink circulation unit, a printer circuit board unit, and a power unit. These are contained within a hollow casing of the apparatus. Although the gutter returns some of the ink which passes to the printing head, the printing operation will use up the ink contained by the ink circulation unit and therefore it is necessary to have access to the ink circulation unit to permit ink to be replaced therein.

Inevitably, when new ink is supplied to the ink circulation unit, even if it is supplied in a container rather than being poured into the casing, there is risk of spillage of the ink. It is undesirable for the ink to come into contact with other components within the casing. This problem is particularly acute when the printing apparatus is to be of small size, since the components within the casing are necessarily proximate each other.

Therefore, according to a first aspect of the present invention, the interior of the casing is separated into upper and lower regions, with the ink circulation unit being in the lower region and the circuit board unit and the power unit being in the upper region. Then, if ink is split whilst supplying new ink to the ink circulation unit, it will not fall into contact with the circuit board unit or power unit.

It should be noted that the references to "upper" and "lower" in the above discussion of the first aspect of the present invention refer to directions relative to the normal orientation of the casing of the apparatus. That normal orientation is usually determined by the direction and mounting of a display panel in a panel wall of the casing.

Preferably, the casing has an access cover permitting access to the ink circulation unit, and that access cover is preferably in a front wall of the casing, between the base of the casing, and the display panel. Printing medium (ink and/or solvent) may then be supplied to the ink circulation unit via that cover. For example, separate ink and solvent containers may be provided which are insertable into, and removable from, the ink circulation unit via the access cover. In this way, it is possible to replace ink and/or solvent which has been used up by the action of printing by the ink jet printing apparatus.

Preferably, the ink circulation unit has a filter therein for filtering the ink, and it is preferable that such a filter be mounted near the access cover, to permit easy replacement thereof. The casing may also contain means for cooling the interior of the casing (e.g. a fan for circulating air therein), and that cooling means is also preferably in the lower space within the casing.

The upper space may itself be divided by a further partition wall, to separate the circuit board unit from the power unit. For convenience, the circuit board unit is preferably adjacent the display panel, with the circuit board or circuit boards thereof mounted vertically.

The ink circulation unit is preferably connected to a printing head via a flexible tube, so that the printing head may be mounted in any desired position relative to the casing. In this way, the printing head may be mounted with a suitable orientation relative to a product production line, with the display panel in the casing being accessible by the operator. The second and third aspects of the present invention then relate to the structure of the printing head.

As previously mentioned, a printing head for an ink jet printing apparatus of continuous type has a nozzle from which ink particles are jetted, a charging electrode for charging some of the particles, a deflection plate for deflecting the charged particles, and a gutter for receiving other particles. In a second aspect of the present invention, the nozzle, charging electrode, and deflection plate are mounted on a common support plate, on which is also mounted a filter. Since the filter may need to be replaced, or at least cleaned, it is mounted on the support plate separately from the nozzle, at a spaced apart location therefrom. Hence, the filter can be cleaned without removing the nozzle. Removable of the nozzle is undesirable because the orientation of the nozzle relative to the charging electrode and deflection plate may then be changed.

The nozzle and filter may be contained in a cover, to permit the charging electrode and deflection plate to be immersed in cleaning fluid to clean them, but if so there may be an aperture in the cover to permit access to the filter unit.

The gutter may also be mounted on the support plate, but is preferably a separate component which is disconnectable from the support plate to permit the gutter to be cleaned. This detachability of the gutter then represents a third aspect of the present invention.

Although each of the three aspects of the present invention discussed above are independent, they may be used together in any combination.

BRIEF DESCRIPTION OF THE DRAWINGS

An embodiment of the present invention will now be described in detail, by way of example, with reference to the accompanying drawings, in which.

DETAILED DESCRIPTION

Figure 1:
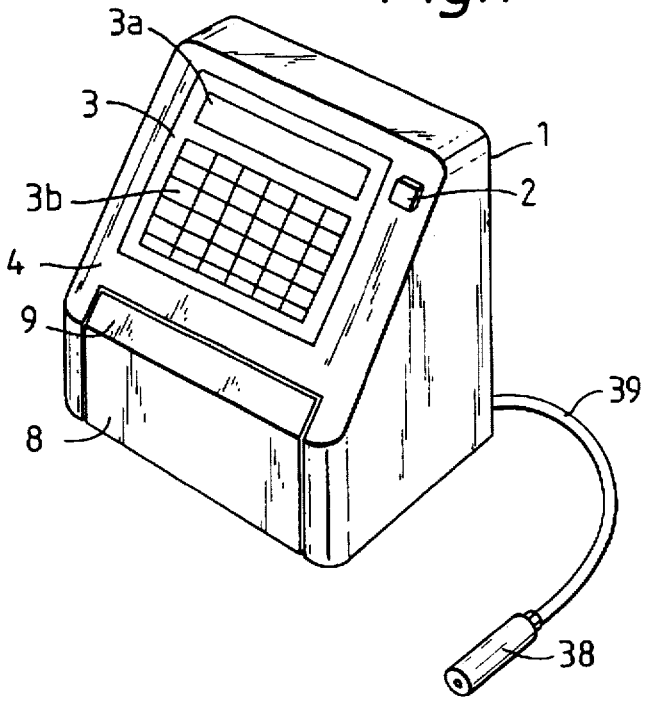
FIG. 1 is a perspective view of an ink jet printing apparatus of continuous type, being an embodiment of the present invention.

FIG. 1 shows a perspective view of an embodiment of the present invention, being an ink jet printing apparatus of continuous type. The apparatus has a casing 1 which, as will be described later, is hollow. A power switch 2, and a display panel 3 formed by a liquid crystal display 3*a* and keyboard 3*b* are mounted in a panel wall 4 of the casing 1, which panel wall 4 is inclined for ease of visibility and operability of the display panel. Below the panel wall 4 is a front wall, containing an access cover 8 therein. In this embodiment, the access cover has a flap 9 extending into the panel wall 4. FIG. 1 also shows a printing head 38 which is connected to the rest of the apparatus via a flexible connecting tube 39. The printing head 38 will be described in more detail later.

Figure 2:
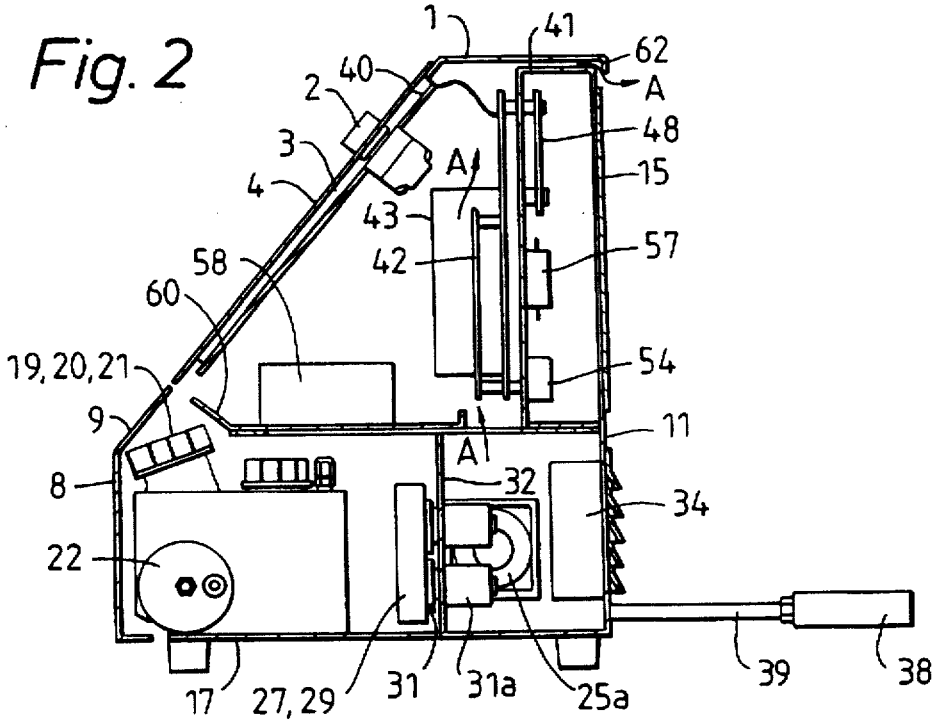
FIG. 2 is a vertical sectional view through the ink jet printing apparatus of FIG. 1.
Figure 3:
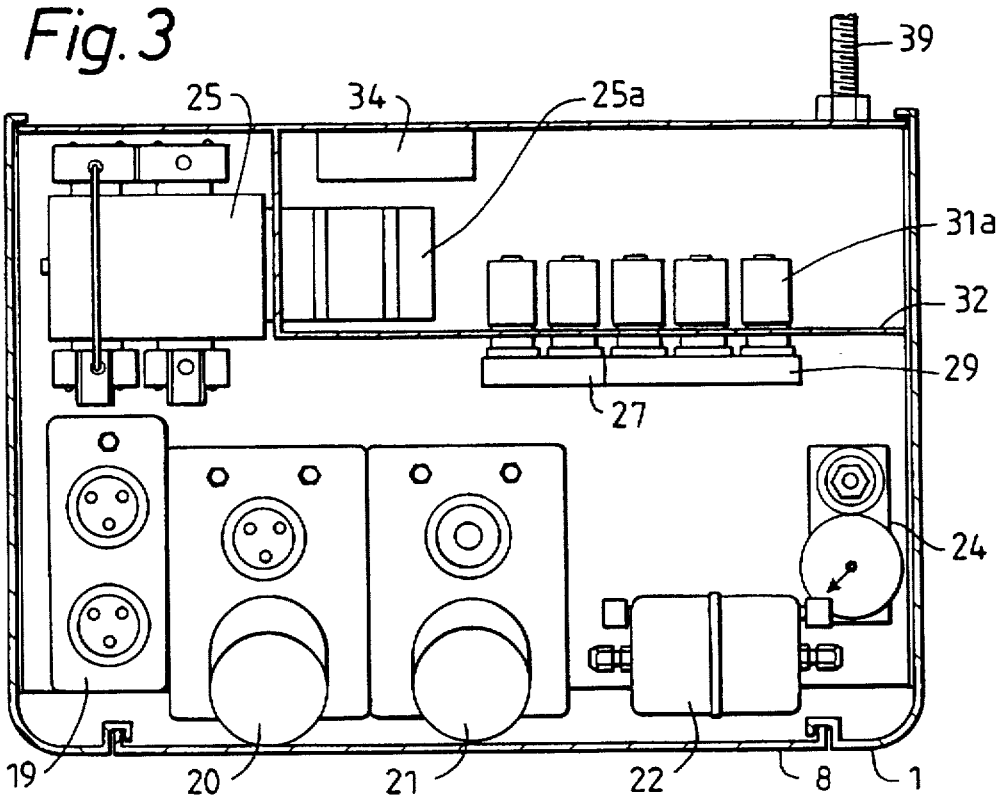
FIG. 3 is a sectional plan view of the ink jet printing apparatus of FIG. 1, showing the ink circulation unit thereof.
Figure 4:
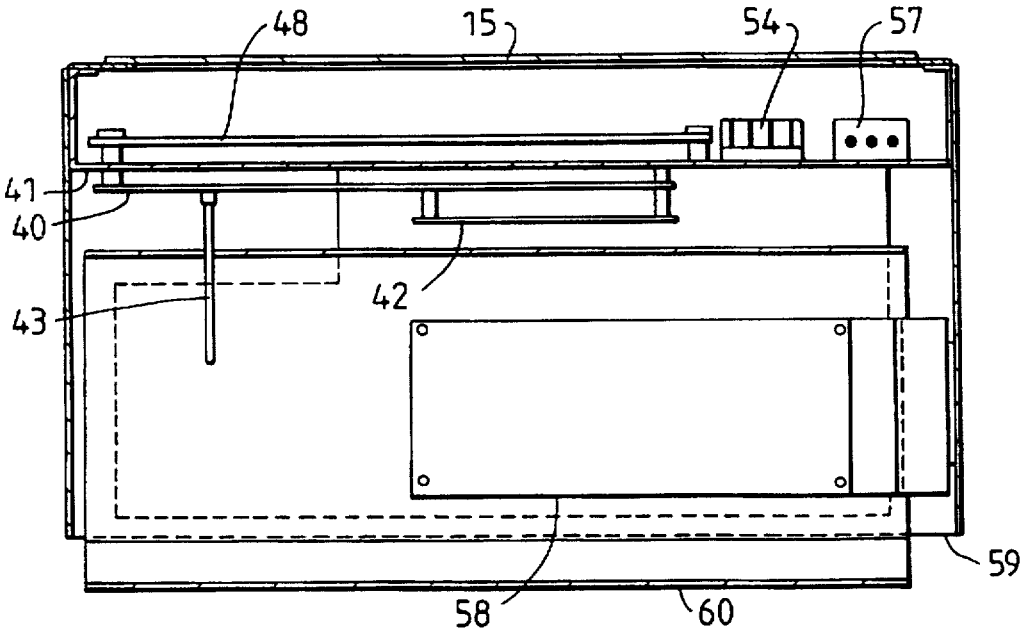
FIG. 4 is a vertical plan view of the ink jet printing apparatus of FIG. 1, showing the circuit board unit and the power unit thereof.

FIG. 2 is a sectional side view of the inside of the printing apparatus of FIG. 1. FIG. 3 is a top view of the ink circulating unit inside the printing apparatus, and FIG. 4 is a top view of the control unit of the printing apparatus.

FIG. 2 shows that the casing 1 has a base 17 which supports the rest of the printing apparatus. The cover 8 is hingedly connected to the base 17, to permit access to the interior of the casing 1, and FIG. 2 shows more clearly the inclination of the panel wall 4.

The components within the casing 1 are divided into several units. In particular, there is an ink circulation unit for circulating ink to and from the printing head 38, a printed circuit board unit for controlling the ink circulation unit (and also the display panel 3), and also a power unit for supplying power to the other components. These units will now be described in more detail.

The components of the ink circulation unit are mounted on the base 17. At the front of the base 17 are containers such as a main ink container 19, secondary ink container 20, a solvent container 21 and a filter 22 for trapping dust in the circulation passages to and from the printing head 38. These are all components which require maintenance. At the back of the base are components which do not normally need maintenance. These include a pump 25 for generating pressure to transfer and recover ink or solvent, and a plurality of electro-magnetic valves 31 for opening/closing the circulation passages to and from the printing head 38. A motor 25*a* for driving the pump 25 and solenoids 31*a* for driving the electro-magnetic valves 31 are separated from the rest of the ink circulation unit by a partition plate 32. If the motor 25*a* and the solenoids 31*a* need maintenance, this is achieved from the back of the apparatus by removing a rear panel 11. This separation of the components of the ink circulation unit is desirable because the containers 20 and 21 and the filter 22 need to be replaced regularly, whereas the motor 25*a* and solenoids 31*a* need maintenance only if there is a failure in these components. Thus, the containers 20 and 21 and the filter 22 are easily accessible from the front of the apparatus via the access cover 8. They can thus be removed and replaced without the apparatus being moved from its desired position.

Figure 5:
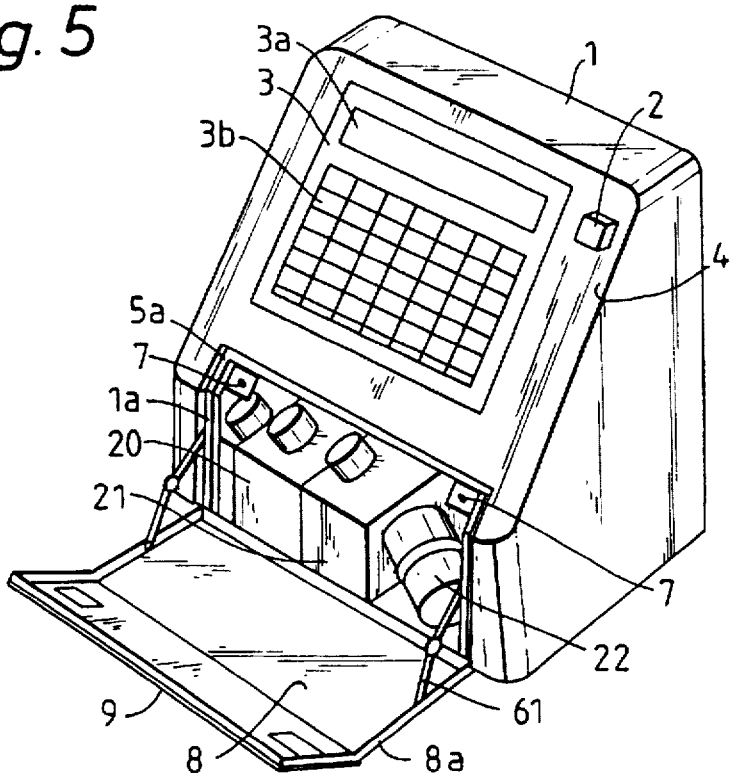
FIG. 5 is a perspective view similar to FIG. 1, but with an access cover open.

Thus, as shown in FIG. 5, opening the access cover 8 permits access to the components in front of the base plate. FIG. 5 shows that the auxiliary ink container 20, the solvent container 21 and the filter 22 which require scheduled maintenance are positioned immediately inside the access cover 8, so that they can be handled when the access cover 8 is opened. The access cover 8 opens forwardly and stops in the horizontal position when it is opened. This may be achieved by struts 61, or when the access cover 8 contacts the surface on which the printing apparatus is mounted. The access cover 8 has an internal rim 8*a* so that it can be used as a tray on which parts for maintenance such an ink can be placed. A convex shaped periphery formed by a depression in the central portion or by attaching other members in the periphery may be usable instead of the rim 8*a* in order to prevent ink or solvent or small screws from dropping out of the tray during maintenance. The flap 9 also assists this effect.

The access cover 8 is fixed by magnetic fasteners 7 at the top of the opening in the casing 1. Although two fasteners 7 are provided on opposite sides of the access cover 8 in FIG. 5, one fastener may be provided at the center thereof. A damper may be provided in the hinge portion or in the vicinity thereof, so that the access cover 8 will open gradually.

Figure 6:
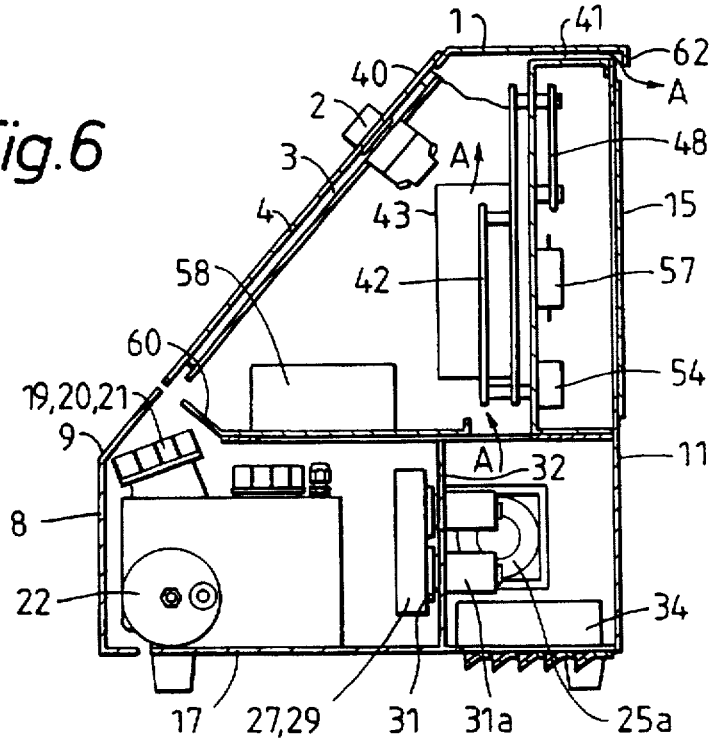
FIG. 6 is a sectional view corresponding to FIG. 2, but showing a fan unit in an alternative position.

Returning to the internal structure of the printing apparatus, the motor 25*a*, the solenoids 31*a*, and electro-magnetic valves 31 are heat sources, and it is important that these heat sources are cooled. Therefore, a fan unit 34 is provided at the back of the heat sources to introduce external air into the casing 1 and cool the heat sources. The fan unit 34 is preferably on the rear wall of the casing 1, but may be at the bottom of the casing 1 as shown in FIG. 6. The air from the fan unit 34 flows in the direction of the arrows A, to the upper part of the casing 1 so that the air which has passed through the heat sources of the ink circulation unit flows upward and cools other components. With the construction, both of the ink circulating unit and the other components are cooled with a limited amount of air. The air flowing upward passes out of the casing 1 of the printing apparatus through a gap 62 at the tope of the casing 1. The fan unit 34 may also increase the pressure inside the upper part of the casing 1 relative to the pressure in the ink circulating unit, to prevent solvent vapor from flowing into the upper part of the casing 1 when a solvent leakage accident occurs inside the ink circulating unit.

The above description illustrates that all the components of the ink circulation unit are placed in the lower portion of the casing 1 of the printing apparatus. Other components are located above the ink circulating unit.

As shown in FIGS. 2 and 3, a control board 40 for controlling the printing apparatus is attached to a board base 41. In this embodiment, a nozzle head driving board 42 and a memory board 43 having a main apparatus driving program are connected to the control board 40, these components forming a printed circuit board unit.

An input/output unit (in this embodiment an input/output board 48 is used), which an operator connects to an external unit, and connecting unit 54 for a power line are installed on the reverse side of the board base 41, and connection work is performed by removing a connection port plate 15. A noise filter 57 for removing the line noise, which is placed immediately after the power line, is also installed on the board base 41. A constant voltage unit 58 is placed in front of the control board 40, and a partition plate 60 for separating the ink circulation unit from the control unit is placed under the constant voltage power unit 58. Since the partition plate 60 may be removable, maintenance of the ink circulation unit is easily performed by removing the partition plate 60.

Thus, the interior of the casing 1 may be considered to be divided into three regions. Firstly, the partition plate 60 divides the interior of the casing into an upper region and a lower region between the partition plate 60 and the base 17. The ink circulation unit, and also the cooling means formed by the fan unit 34 are located in that lower region. The upper region, above the partition plate 60, is itself divided into two regions by the board base 41. At first region, between that board base 41 and the display panel 3 contains the printer circuit board unit, comprising the control board 40, the nozzle head driving board 42, and the memory board 43. As can be seen from FIG. 2, these boards are mounted vertically in that region. In the second region, on the opposite side of the board base 41 from the printed circuit board unit, is the connecting unit 54 which acts a power unit for the apparatus since it connects the apparatus to a power line, and thus provides power for the ink circulation unit and the printed circuit board unit.

It should be noted that, in this description, the references to "upper" and "lower", and also "front" and "back" refer to directions when the printing apparatus is in its normal orientation. This orientation is, in practice, determined by the orientation of the display panel 3, since the apparatus is orientated so that the display panel is immediately accessible and clearly readable, by the user.

The detailed structure of the internal components of the printing apparatus will now be described in detail, with reference to FIGS. 7 to 10.

Figure 7:
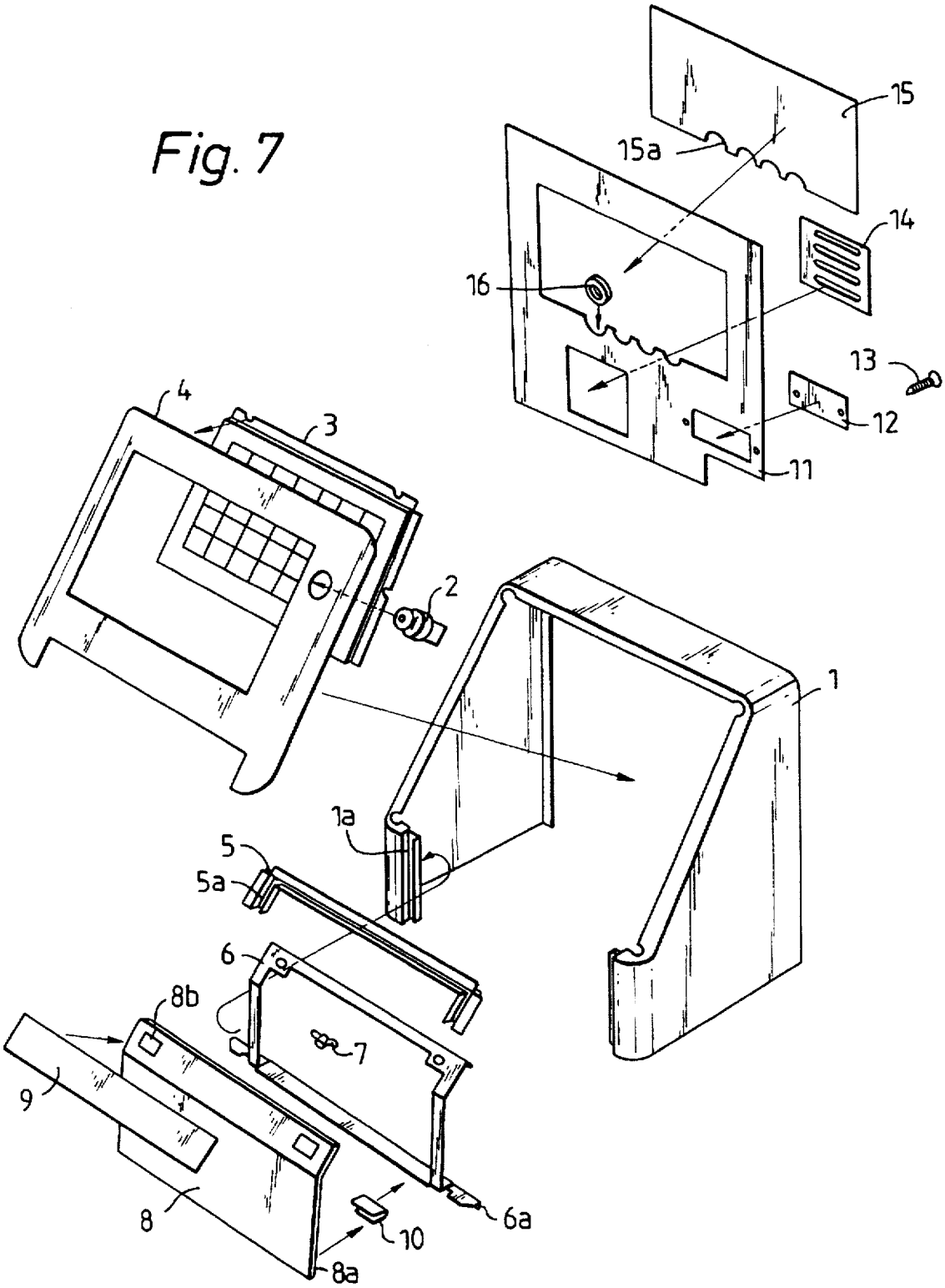
FIG. 7 is an exploded perspective view of the cover of the ink jet printing apparatus of FIG. 1.

FIG. 7 is a detailed view of the cover 1 and other external components. The display panel 4 is attached to the rest of the cover 1, and the power switch 2 and the input/output unit 3 are attached to the display panel 4. A reinforcing base 6 serves as a reinforcing member for the cover 1 and as an attachment portion for the access cover 8. There is an access cover support 5 having a concave portion 5*a* above the reinforcing base 6, the rim portion 8*a* at the periphery of the access cover 8 engaging the concave portion 5*a* when the access cover 8 is closed. Since the bottom edge of the concave portion 5*a* engages a concave portion 1*a* of the cover 1, any liquid on the cover will flow down along the concave portions 5*a* and 1*a* even when water or other liquid is spilt on the display panel 4. This prevents liquid from entering the interior of the apparatus.

As mentioned previously, magnetic fasteners 7 are provided on both sides of the top of the reinforcing base 6 to secure the access cover 8 in a closed position. Since the fasteners 7 are magnetic, the access cover 8 is closed by pushing the top central portion of the access cover 8, and is opened by pushing again there. Since stainless steel is used for the access cover 8 in this embodiment, the magnets of the fasteners 7 are fixed to the flap 9 which is made of steel. Therefore, the access cover 8 has two holes for two magnet attracting windows 8*b* used for the fastener 7.

The hinge 10 connects the access cover 8 to the reinforcing base 6. If the hinge 10 has a damper function, the access cover 8 is prevented from opening abruptly. At the bottom of the reinforcing base 6 is a fold back 6*a* for reinforcement, which also acts as a stopper for holding the access cover 8 in a horizontal position when it is opened.

A breaker cover 12, to be opened during breaker operation, is fixed to the back surface plate 11 by a fastener 13. A fan filter cover 14 is placed in the position corresponding to the back portion of the fan unit 34, a connection port plate 15 is provided at a position corresponding to the back of the input/output unit to be connected with external units by the operator and the connecting unit for a power source line. Cable protection rubber bushings 16 are provided on each of the holes 15*a* for cables.

Figure 8:
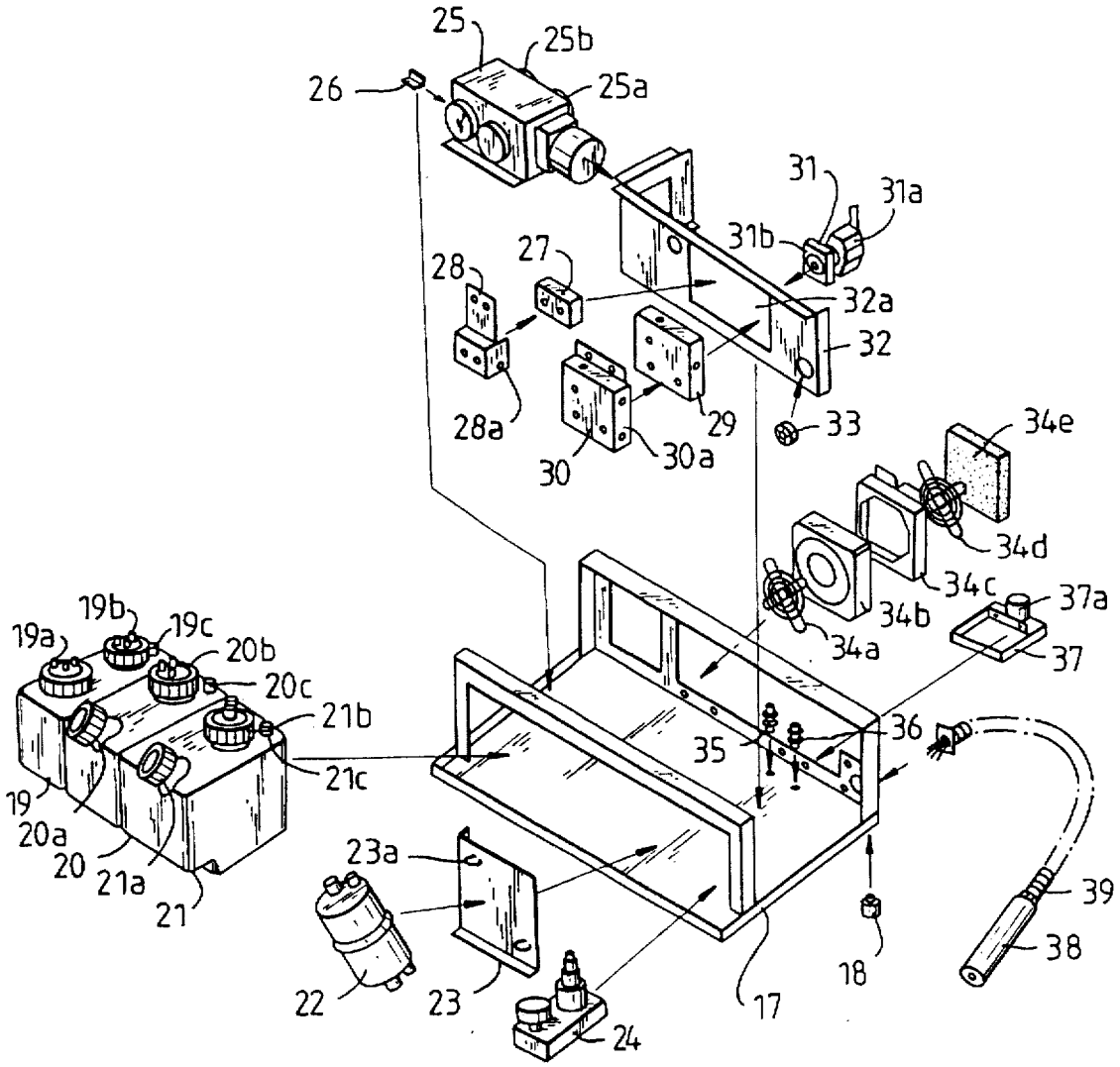
FIG. 8 is an exploded perspective view of the ink circulation unit of the ink jet printing apparatus of FIG. 1.

FIG. 8 is a detailed view of the ink circulating unit. As previously described, there is a main ink container 19 for recovering and containing the ink which has not been used in printing, an auxiliary ink container 20 for containing ink which is to be supplied to the main ink container 19, the amount of ink thus supplied corresponding to the amount which has been used in printing, and a solvent container 21 for containing the solvent which is supplied in an amount corresponding to the amount of solvent which has evaporated. A cap 19*a* having an ink suction port and an ink recovering port is provided at the front of the main ink container 19. A sensor 19*b* for detecting the level of ink in the main ink container 19 and an exhaust port 19*c* are provided at the back of the main ink container. A cap 20*a* for pouring ink is provided in the front of the auxiliary ink container 20. A sensor 20*b* for detecting the liquid level of ink in the auxiliary ink container 20 and an exhaust port 20*c* are provided at the back of the auxiliary ink container 20. A cap 21*a* for pouring solvent is provided at the front of the solvent container 21. A sensor 21*b* for detecting the liquid level of solvent in the solvent container 21 and an exhaust port 21*c* are provided at the back of the solvent container 21.

A filter 22 for filtering the circulating ink is fixed by a clamp 23*a* to a filter mount 23 at the front surface of the base 17.

At the front of the base 17 is a pressure control valve 24 having a pressure gage in order to keep constant the ink pressure of the ink which is transferred to the nozzle unit of the printing head 38.

The pump 25 has four pump heads 25*b* each of which operate work with the phase difference of 90°, driven by the motor 25*a*. The pump is installed on the base 17 by fixing hardware 26.

Figure 10:
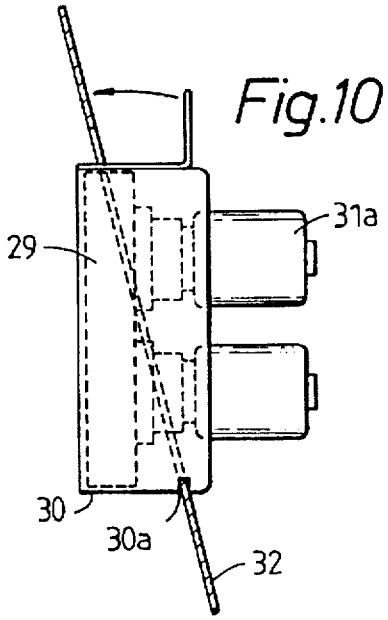
FIG. 10 is a schematic view showing the method of mounting of a flow passage block base in the ink jet printing apparatus of FIG. 1.

Electro-magnetic valves 31 driven by the solenoids 31*a* are connected via sealing members 31*b* to flow passage blocks 27 and 29 having engraved flow passages. The flow passage blocks 27, 29 may be formed in a unit, although they are separate in this embodiment. The flow passage blocks 27, 29 are fixed to the flow passage block bases 28, 30 respectively. Each of the flow passage block bases 28, 30 has grooves 28*a*, 30*a* which hook to the bottom of an electro-magnetic valve mounting hole 32*a* on a portion plate 32 as shown in FIG. 10. The partition plate 32 separates the ink circulating unit into a side corresponding to the motor 25*a* and the solenoid 31*a* and a side in which the ink circulates.

The fan unit 34 comprises a fan cover 34*a*, a fan main body 34*b*, a fan belt 34*c*, a spacer 34*d* and a fan filter 34*e*.

An exhaust tube from the exhaust port 29*c* attached to the main ink container 19 is connected to a joint 35 through a tube protecting bush 33 attached to the partition plate 32. Exhaust tubes from the exhaust port 20*c* attached to the auxiliary ink container 20 and from the exhaust port 21*c* attached to the solvent container 21 are joined into one tube which is connected to a joint 36 through the tube protecting bush 33 attached to the partition plate 32. In this embodiment, since the amount of air from the exhaust port 19*c* attached to the main ink container 19, which receives the recovered ink unused in printing is the largest of the three exhaust ports, the exhaust tube from the exhaust port 19*c* is independent. Three tubes may be joined into one tube, or three separate tubes may be provided. The exhaust air transferred to the joints 35, 36 passes to the bottom of the base 17. An exhaust duct 37 is provided at the bottom of the exhaust portion, and a duct is connected to a duct connecting tube 37*a* to permit the air to be sucked at a given flow rate. The exhaust duct 37 also prevents the installation floor of the apparatus from becoming soiled with ink dye contained in the exhaust air.

Legs 18 are attached to the four corners of the base 17.

Figure 9:
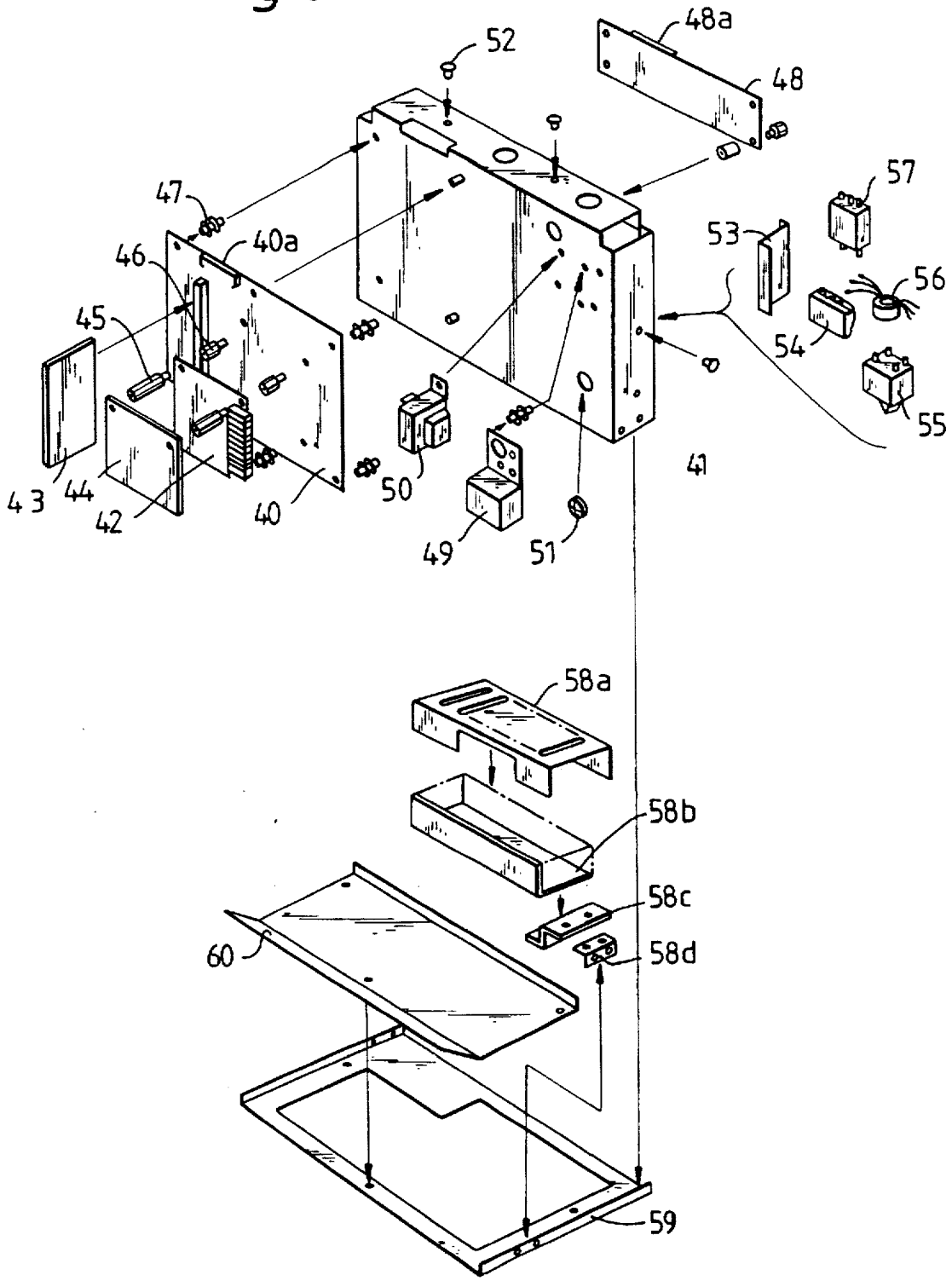
FIG. 9 is an exploded perspective view of the circuit board unit and the power unit of the ink jet printing apparatus of FIG. 1.

FIG. 9 is a detailed view of the components forming the printed circuit board unit and the power unit, which are installed above the ink circulation unit shown in FIG. 8. The control board 40 supports a microcomputer for controlling the apparatus and is mounted on the board base 41. The nozzle head driving board 42 and the memory board 43, which stores an apparatus driving program, are connected to the control board 40. A transparent cover 44 of e.g. resin prevents the operator from inadvertently touching to the nozzle head driving board 42 which processes high voltage analog signals and has a high temperature heat source.

An input/output unit (in this embodiment an input/output board 48 is used), which the operator connects to an external unit, and a connecting unit 54 for the power line are installed on the reverse side of the board base 41.

The input/output board 48 is positioned so that it faces the control board 40, the connector 40*a* and 48*a* on the boards being arranged so that the connection between the input/output board 48 and the control board 40 is as short as possible and the connectors 40*a* and 48*a* on the boards are aligned so that they face each other.

A ferrite core 56 and the noise filter 57 are placed immediately after the power line to remove the line noise, and are mounted on the back of the board base 41. In order to prevent a noise component on the reverse side of the board base 41 from coming to the control board 40 side, the board base 41 is grounded. There is a breaker 55 at the lower side of the reverse surface of the board base 41, which allows the breaker to be operated from the back of the printing apparatus by removing the breaker cover 12.

At the front of the board base 41, there are provided a power transformer 50 to produce character signals for charging the ink particles during printing and a high voltage power source 49 to obtain high voltage for deflecting the charged ink particles. The board base 41 has a bush 51 and a spacer 52. The spacer 52 is used to form a gap 62 between the cover 1 and the board base 41. As previously described, the gap 62 is an air exit port for the passage of cooling air out of the printing apparatus.

The partition plate 60 is placed on a control unit base 59, and the constant voltage power source unit 58 is placed on the partition plate 60 and in front of the control board 40. The constant voltage power source unit 58 comprises a power source cover 58*a*, a constant power source 58*b*, a power source mounting hardware 58*c* and a hinge 58*d*. The partition plate 60 can be removed after the constant voltage power source 58 is lifted up, pivoting on the hinge 58*d*. By removing the partition plate 60, the ink circulating unit is opened. Therefore, the maintenance of the ink circulating unit can be performed with ease.

The embodiment of the present invention, as described above, may thus permit the following effects to be achieved:

1) Since the daily operation and the scheduled maintenance work can be performed from the front of the apparatus, an operator can operate the apparatus from in front of the apparatus only, which improves the workability thereof.
2) Since all the scheduled maintenance work dealing with ink and solvent can be performed from the lower part of the apparatus and in front of the display panel, the ink spilled by an operator by mistake during maintenance cannot be spilt into other components.
3) Since the access cover can be used as a tray, it is possible to prevent loss of ink or solvent or of small parts such as screws.
4) Since the ink circulating unit, the circuit board unit, the power unit and the driving unit for the pump and for the electromagnetic valve are divided by partition plates, solvent vapor does not enter other parts of the apparatus. Thus, the maintenance operations can be performed safely.
5) Since the control board mounting the micro-computer dealing with weak electronic signals, the input/output board and the input power source line side are shielded by grounded metallic plates, the apparatus can be reinforced against noise.

Figure 13:
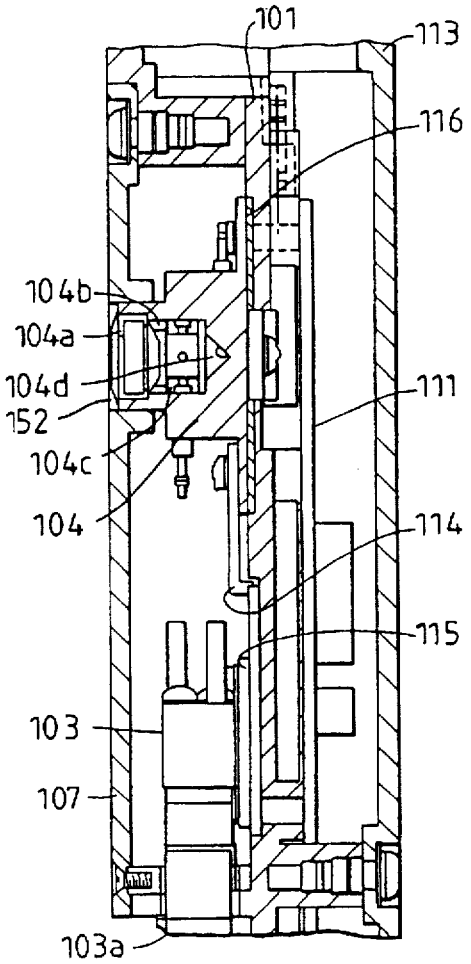
FIG. 13 is a sectional view through part of the printing head of the ink jet printing apparatus of FIG. 1.

The above description has concentrated on the structure of the main part of the printing apparatus, excluding the printing head 38. The structure of that printing head 38, incorporating aspects of the present invention, will now be described in detail with reference to FIGS. 11 to 13.

Figure 11:
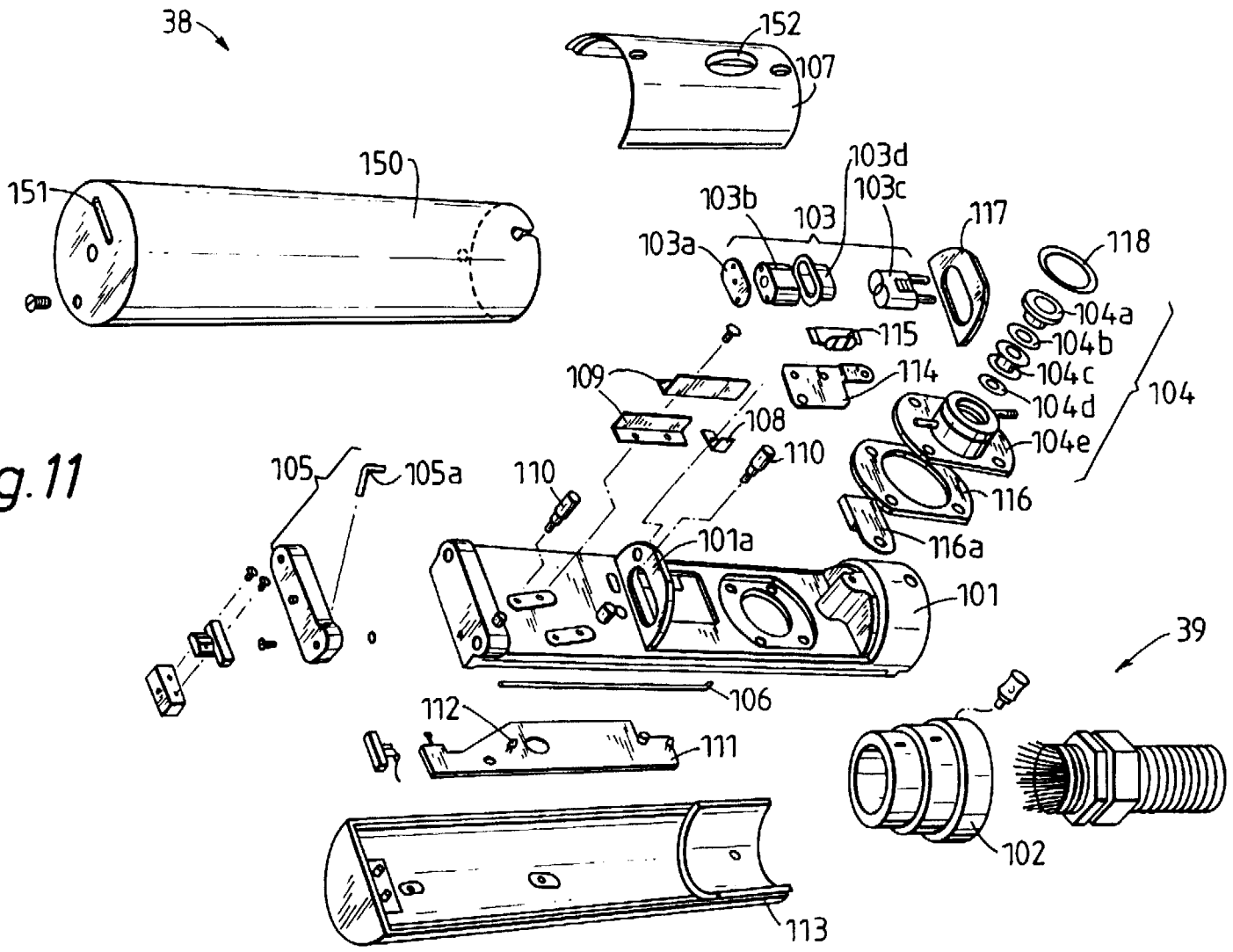
FIG. 11 is an exploded perspective view of the printing head of the ink jet printing apparatus of FIG. 1.

FIG. 11 shows the printing head 38 when disassembled. Components forming the printing head 38 are arranged on the top and bottom surfaces of a base 101 made of plastics material.

On the top surface of the base 100 there is a partition plate 101*a* approximately at the center of the base 101. At the front of the partition plate 101*a*, there are printing components as will be described later. At the rear of the partition plate 101*a*, is tubing which passes from the partition plate 101*a* through the inside of the tube 39, the tube 39 being connected to the rear end of the base 100 via a fastening 102. The tube 39 connects the printing head 38 to the rest of the printing apparatus as described previously.

A nozzle 103, to which the tubing is connected, comprises a front plate 103*a*, a flow passage unit 103*b*, a vibration unit 103*c* and a packing 103*d*. The front plate 103*a*, the flow passage unit 103*b* and the vibration unit 103*c* are assembled together by screws or the like. The packing 103*b* has a brim portion and a hollow portion. The flow passage unit 103*b* is inserted into the hollow portion of the packing 103*b*. The nozzle 103 is attached to the base 100 using a nozzle base 114 and a nozzle stay 115. A rectangular-shaped concave portion is formed on the base 101 in order to mount the nozzle base 114. The nozzle base 114 is attached to the base 100 by being engaging to the concave portion. The nozzle stay 115 is secured to the nozzle base 114 with screws, and the vibrating unit 103*c* is attached to the nozzle stay 115 with screws. The brim portion of the packing 103*b* is supported by being held between the reverse side of the partition plate 101*a* and a packing holder 117. The brim portion of the packing 103*b* prevents cleaning liquid from entering from the front of the partition plate 101*a*. The partition plate 101*a* and the packing holder 117 have holes large enough to fit the periphery of the nozzle 103.

A filter block 104 for removing impurities from the ink is arranged at the rear of the top surface of the base 101, and is positioned at the back of the nozzle 103. The filter block 104 comprises a heater 116*a*, a packing 116, a filter unit base 104*c*, a TF filter 104*d*, a spacer 104*c*, an O-ring 104*d* and a filter holding screw 104*a*.

The filter unit base 104*e* is fixed to the base 101 by the packing 116. The heater 116*a* is placed on the bottom surface of the filter unit base 104*e*. The TF filter 104*d* is inserted in the inside bottom of the filter unit base 104*e*. The spacer 104*c* is placed on the TF filter 104*d*, and the filter holding screw 104*a* is attached to the spacer 104*c* through the O-ring 104*b*. Another O-ring 118 is held between the top cover 107 and the filter block 104.

A gutter block 105 is also attached to the front of the top of the base 101. A recovering pipe 106 for the gutter extends along the bottom surface of the base 101 and extends into the gutter block 105 since it is exposed from the top front of the base 101. A pipe 105*a* acting as a gutter receiver is inserted into the gutter block 105. This pipe communicates with the recovering pipe 106 for the gutter through a flow passage in the gutter block 105.

The tubing inside the tube 39 connects to the recovering pipe 106 and to various other parts such as the vibration unit 103*c*. The rear top portion of the partition plate 101*a* is covered by a top cover 107. Sealing material is filled into the junction surface between the top cover 107 and the base 101, and the top cover 107 is fixed to the base 101 by screws. The top cover 107 is not usually removed. A charging electrode 108 and deflecting electrodes 109 at the front of the partition plate 101*a* are attached to the base 101 by screws. The charging electrode 108 charges character signals onto ink particles jetted from the nozzle 103. The deflecting electrodes 109 deflect the charged ink particles, and are placed forward of the charging electrode 108 relative to the nozzle 103.

There are sensors 110 at the front and on the back of the deflecting electrodes 109. The sensors 110 are attached to the base 101 by press fitting. The sensors 110 detect the charges on the ink particles and measure the speed of the ink particles passing through both sensors 110 in order to control printing.

A junction board 111 for electric signals such as printing control signal is placed on the bottom surface of the base 101. The signal lines therefor extend inside the table 39 and are connected to electric components on the junction board 111 from the main part of the printing apparatus described previously. Since the junction board 111 is attached to the base 101 using spacers, the base 101 has gaps for inserting spacers and gaps for fitting a stroboscope 112 for confirming the path of the ink particles. In order to close these gaps, sealing material is painted onto the base 101. When the top of the base 101 is cleaned using solvent, the sealing material prevents the solvent from reaching the bottom surface.

The bottom surface side of the base 101 is covered with a bottom cover 113. The bottom cover 113 is attached to the base 101 after wiring of the junction board 111 has been completed. Sealing material is filled into the junction surface between the bottom cover 113 and the base 101, and the bottom cover is fixed to the base 101 with screws. The bottom cover 113 is also not usually removed. Finally, the parts of the printer head 38 described above are slid into an outer cylindrical cover 150, which has a slot 151 through which ink particles jetted from the nozzle 103 and deflected by the deflecting electrodes 9 can pass to an object to be printed. The cover 150 is removed when maintenance of the printer head 38 is required.

Next, the junction portions in the top cover 107 and the bottom cover 113 will be described in detail, referring to FIGS. 12(*a*) and 12(*b*).

Figure 12A:
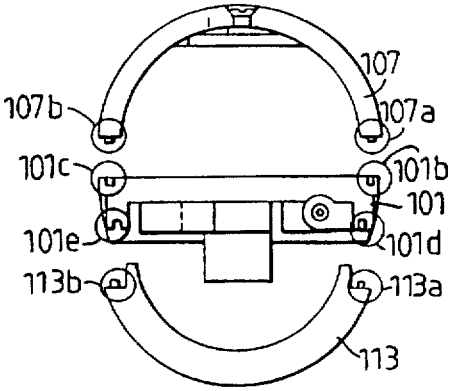
FIGS. 12(*a*) and 12(*b*) are enlarged views of parts of the printing head of FIG. 11.
Figure 12B:
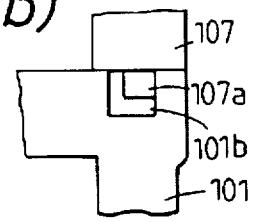

Projecting portions 107*a*, 107*b* are formed on both lower ends of the top cover 107 as shown in FIG. 12(*a*). Similarly, concave portions 101*b*, 101*c* are formed on both side edges of the top surface of the base 101 as shown in FIG. 12(*a*). The concave portions 101*b* band 101*c* receive the convex portions 107*a* and 107*b*. The assembling procedure is for sealing material to be put into the concave portions 101*b* and 101*c*, then the convex portions 107*a* and 107*b* are fitted therein. It is desirable that any sealing material which is pressed out of the concave portions 101*a*, 101*b* during assembly is wiped off. The sealing material is preferably silicone rubber of room temperature hardening type. The depth of the concave portions 101*b*, 101*c* is longer than the height of the convex portions 107*a*, 107*b*, and the width of the concave portions 101*b*, 101*c* is longer than the width of the convex portions 107*a*, 107*b* as shown in FIG. 12(*b*). Therefore, enough the sealing material remains in the concave portions 101*b*, 101*c* to improve the sealing effect.

Since the top cover 107 and the base 101 are joined to each other by convex/concave fitting, any difference in size, existing between the top cover 107 and the base 101 is corrected.

In the same way, convex portions 13*a*, 13*b* are formed on both upper ends of the bottom cover 13, and concave portions 101*d*, 101*e* are formed on both side edges of the bottom surface of the base 101. The concave portions 101*d*, 101*e* on the base 101 and the convex portions 113*a*, 113*b* on the bottom cover 113 are joined to each other. The assembling procedure is the same as that for the top cover 107 and the base 101 described above.

The cleaning of the printing head 38 will now be described.

The first step in cleaning is to remove the cylindrical cover 150. When the cylindrical cover 150 is removed, the deflecting electrodes 109, the charging electrode 8, the sensors 10, the gutter and the top front portion 3*a* of the nozzle 103 are exposed. Then, cleaning liquid such as ink solvent is poured on the front side of the top portion of the base 101, or the front side of the printing head 38 is dipped into the cleaning liquid to clean it.

Such cleaning removes any ink adhering to the top front portion 3*a* of the nozzle, the gutter, the sensors 10, the charging electrode 8 and the deflecting electrode 9. It is desirable to perform such cleaning immediately after the operation of the ink jet printing apparatus has stopped. It is also desirable to clean the inside of the cylindrical cover 150 since the inside of the cylindrical-shaped cover 150 may be soiled with ink.

During such cleaning, there is no possibility that the cleaning liquid can enter into the inside of the top cover 107 or the bottom cover 113. Hence, although the top front portion 103*a* of the nozzle 103 is exposed from the window portion of the partition plate 101*a*, the cleaning liquid cannot reach the inside of the top cover 107 through the window portion since the window portion is pressed against the reverse side of the partition plate 101*a* by the packing holder 117 through the brim portion of the packing 103*b*. The cleaning liquid cannot reach the inside of the top cover 107 through the joining surface since the top cover 107 is sufficiently sealed at the surface joined to the base 101. The cleaning liquid cannot permeate into the junction board 111, since the junction board 111 on the bottom surface of the base 101 is covered by the bottom cover 113 and the joining surface between the bottom cover 113 and the base 101 is sealed as described above. Since the gaps formed in the fitting holes for the spacers attaching the stroboscope 112 or the junction board 111 are sealed with a coating of sealing material, the cleaning liquid cannot enter from the upper surface of the base 101 into the bottom of the base 10, since it is 1 covered by the bottom cover 113.

There is a hole 152 (see FIG. 11) in the top cover 107, for changing the TF filter 104*d*. Since the top portion of the filter unit base matches the hole 152 and the O-ring 118 is interposed in the joining surface (see FIG. 13), the sealing in this joining surface is sufficient. Therefore, the cleaning liquid cannot reach the inside of the top cover 107 through the hole 152 for changing the filter 104*d*.

The procedure to change the TF filter is for the filter holding screw 104*d* to be removed through the hole 152 in the top cover 107, and the TF filter 104*d* can then be removed together with the O-ring 104*b* and the spacer 104*c*. Then the FT filter can then be replaced by a new one, if necessary.

Next, suppose that the nozzle 103 becomes choked. The top front 103*a* of the nozzle 103 projecting from the partition plate 101*a* is removable. If the nozzle 103 is not restored to its normal state, by cleaning using solvent which is provided as a function of the apparatus, the nozzle 103 can be restored to its normal state by removing the top front portion 103*a* of the nozzle 103 and cleaning it with an ultrasonic cleaning machine. Employing a flat counter-sunk head screw may provide sufficient repeatability of nozzle 103 positioning, to eliminate the need for ink beam adjustment when the top front portion 103*a* of the nozzle 103 is re-assembled after cleaning.

In the printing head 38 of this embodiment of the present invention, the electric signal line connecting region can be separated from the fluid line connecting region for ink and solvent by means of arranging the parts on the top and bottom surfaces of the base. Moreover, the cover can protect the internal parts from the external environment. Normally nozzle beam adjustment is necessary only at the beginning of the operation of the printing head 38, since changing of the filter or cleaning of the nozzle orifice portion can be performed without removing the nozzle.

Thus, in the present invention, the fluid line connecting region for ink and solvent and the deflecting region for performing printing are provided on the top side of the base, the electric signal line region being provided on the bottom side of the base, sealing being provided in the electric signal line connecting region in order to prevent ink or solvent reaching this region. This can provide a safe apparatus. Cleaning of the printing head can be easily performed since ink or solvent cannot reach the inside of the printing head. There is no need to repeat the ink beam adjustment after each cleaning operation since there is no need to remove the nozzle when changing the filter or cleaning the nozzle orifice portion. This leads to an improvement in the ease of handling of the apparatus.

What is claimed is:

1. An ink jet printing apparatus, comprising:

a hollow casing having a base, a front wall extending upwardly from said base, and a panel wall extending from said front wall;

a dividing wall in said hollow casing, said dividing wall dividing the interior of said hollow casing into a lower region between said dividing wall and said base and an upper region;

an ink circulation unit in said lower region;

a display panel in said panel wall;

a circuit board unit in said upper region for controlling said ink circulation unit and said display panel; and a power unit in said upper region for supplying power to said ink circulation unit and said printed circuit board unit.

2. An ink jet printing apparatus according to claim 1, wherein said front wall contains an access cover for permitting access to said lower region.

3. An ink jet printing apparatus according to claim 2, wherein said ink circulation unit comprises at least one removable container for a printing medium, said at least one removable container being removable through said access cover.

4. An ink jet printing apparatus according to claim 2, wherein said ink circulation unit includes a filter for ink, said filter being mounted adjacent said access cover.

5. An ink jet printing apparatus according to claim 1, wherein said ink circulation unit comprises:

a main ink container;

a secondary ink container;

a solvent container;

means for supplying in from said secondary ink container and solvent from said solvent container to said main ink container;

means for supplying ink from said main ink container to a printer head; and means for returning ink recovered by said printer head to said main ink container.

6. An ink jet printing apparatus according to claim 1, further including a printing head for jetting ink therefrom, said printing head being connected to said ink circulation unit.

7. An ink jet printing apparatus according to claim 6, wherein said printing head is connected to said ink circulation unit by a flexible tube.

8. An ink jet printing apparatus according to claim 6, wherein said printing head comprises:

a support plate;

a filter for receiving ink and filtering said ink, said filter being mounted on said support plate;

a nozzle on said support plate, said nozzle being connected to said filter for receiving said ink therefrom, said nozzle being arranged to jet ink therefrom as ink particles;

charging means on said support plate for electrically charging at least some of said ink particles;

a deflecting electrode on said support plate for deflecting said at least some of said ink particles; and a gutter for receiving said ink particles other than said at least some of said ink particles;

wherein said filter and said nozzle are independently mounted on and removable from said support plate.

9. An ink jet printing apparatus according to claim 6, wherein said printing head comprises:

a support plate;

a filter for receiving ink and filtering said ink, said filter being mounted on said support plate;

a nozzle on said support plate, said nozzle being connected to said filter for receiving said ink therefrom, said nozzle being arranged to jet ink therefrom as ink particles;

charging means on said support plate for electrically charging at least some of said ink particles;

a deflecting electrode on said support plate for deflecting said at least some of said ink particles; and a gutter for receiving said ink particles other than said at least some of said ink particles;

wherein said gutter is detachably connected to said support plate.

10. An ink jet printing apparatus according to claim 1, having a further dividing wall in said upper space, said further dividing wall dividing said upper space into a front space between said further dividing wall and said display panel, and a back space, said printed circuit board unit at an ink circulation unit side being in said front space; and said power unit at a control unit side being in said back space.

11. An ink jet printing apparatus according to claim 10, wherein said circuit board unit has at least one circuit board which extends vertically in said front space.

12. An ink jet printing apparatus according to claim 1, having cooling means for cooling the interior of said casing, said cooling means being located in said lower space.

13. An ink jet printing apparatus according to claim 12, wherein said power unit is adjacent said cooling unit and is separated therefrom by said dividing wall.

* * * * *